US005601057A

United States Patent [19]

Treyz et al.

[11] Patent Number: 5,601,057

[45] Date of Patent: Feb. 11, 1997

[54] VALVE ACTUATING SYSTEM FOR A MULTICYLINDER INTERNAL COMBUSTION ENGINE

[75] Inventors: Willy Treyz, Neckartailfingen; Markus Düsmann, Kemen; Christoph Reckzügel, Stuttgart; Gerhard Doll, Esslingen, all of Germany

[73] Assignee: Mercedes Benz AG, Stuttgart, Germany

[21] Appl. No.: 654,164

[22] Filed: May 28, 1996

[30] Foreign Application Priority Data

May 29, 1995 [DE] Germany ..... 195 19 601.5

[51] Int. Cl.[6] ..... F01L 1/18

[52] U.S. Cl. ..... 123/90.16; 123/90.27; 123/90.34; 123/90.36; 123/90.33; 123/193.5

[58] Field of Search ..... 123/90.15, 90.16, 123/90.17, 90.27, 90.33, 90.34, 90.36, 90.39, 90.44, 193.5, 193.3

[56] References Cited

U.S. PATENT DOCUMENTS

| | | | |
|---|---|---|---|
| 4,537,165 | 8/1985 | Honda et al. | 123/90.27 |
| 4,537,166 | 8/1985 | Kimura et al. | 123/90.34 |
| 4,928,641 | 5/1990 | Niizato | 123/90.16 |
| 5,003,937 | 4/1991 | Matsumoto et al. | 123/90.16 |
| 5,090,364 | 2/1992 | McCarroll | 123/90.16 |
| 5,370,090 | 12/1994 | Murata et al. | 123/90.16 |
| 5,535,704 | 7/1996 | Paul | 123/90.16 |

FOREIGN PATENT DOCUMENTS

| | | |
|---|---|---|
| 0576768 | 1/1994 | European Pat. Off. . |
| 3415245 | 12/1984 | Germany . |
| 3523531 | 2/1986 | Germany . |
| 4221135 | 6/1993 | Germany . |
| 6-88512 | 3/1994 | Japan . |

*Primary Examiner*—Weilun Lo
*Attorney, Agent, or Firm*—Klaus J. Bach

[57] ABSTRACT

In a valve actuating system for a multicylinder internal combustion engine having a camshaft supported in bearing pedestals on the cylinder head of the engine with rocker arms pivotally supported by rocker arm support shafts also mounted on the bearing pedestals and coupling levers arranged adjacent at least some of the rocker arms and including hydraulically operable coupling devices for engagement with the adjacent rocker arms, at least one of the bearing pedestals includes a pressure control space to which oil under pressure is supplied and the rocker arm support shafts have internal fluid flow passages in communication with the pressure control space and with the coupling devices so that pressurized fluid can be admitted to the coupling devices under the control of valve means disposed in the bearing pedestal.

12 Claims, 3 Drawing Sheets

VALVE ACTUATING SYSTEM FOR A MULTICYLINDER INTERNAL COMBUSTION ENGINE

BACKGROUND OF THE INVENTION

The invention relates to a valve actuating system for a multicylinder internal combustion engine with intake and exhaust valves and a cam shaft mounted on bearing pedestals and rocker arms mounted on support shafts and being actuated by the cam shaft for operating the valves.

DE 42 21 135 C1 discloses a valve actuating system for a multicylinder internal combustion engine, a valve being actuated by two actuating levers which can be coupled to one another by means of coupling elements and are driven by two cams with different lobes. The coupling elements are formed by locking pins which are guided in longitudinally displaceable fashion in the coupling levers, parallel to the rocker spindle, and can be subjected to pressure for movement in the direction toward the actuating lever by means of hydraulic oil. In the actuating lever there is a spring-loaded guide cup which serves to reset the locking pin to its initial position in the unpressurized state. To subject the locking pins in the coupling levers to pressure, oil is fed in through a longitudinal passage in the rocker spindle and a transverse hole in the coupling lever. The customary lubricating oil pump of the internal combustion engine can be used as the oil pump, a valve for controlling a switching pressure being provided in a pressurized oil line.

A similar arrangement is described in EP 0 576 768 A1. This arrangement makes it possible to control the coupling elements in such a way that it is possible to perform a valve shutdown, a cylinder shutdown or a lifting curve changeover.

The object on which the present invention is based is to provide for the oil supply of a cylinder head in a simple manner with minimal machining and assembly.

SUMMARY OF THE INVENTION

In a valve actuating system for a multicylinder internal combustion engine having a camshaft supported in bearing pedestals on the cylinder head of the engine with rocker arms pivotally supported by rocker arm support shafts also mounted on the bearing pedestals and coupling levers arranged adjacent at least some of the rocker arms and including hydraulically operable coupling devices for engagement with the adjacent rocker arms, at least one of the bearing pedestals includes a pressure control space to which oil under pressure is supplied and the rocker arm support shafts have internal fluid flow passages in communication with the pressure control space and with the coupling devices so that pressurized fluid can be admitted to the coupling devices under the control of valve means disposed in the bearing pedestal.

The essential advantages of the invention are to be seen in that, by virtue of the arrangement of the valve means in a bearing pedestal of the camshaft, it is possible to provide a common supply of lubricating oil for the bearings and operating fluid for the hydraulic actuation of the coupling elements from the oil pump via a single, pressurized oil line. This also reduces the length of the oil paths between the valve means and the coupling device to a minimum, thereby promoting the response speed of the hydraulic system.

In a further development of the invention, the valve means are arranged in a valve housing which is an integral part of the bearing pedestal. This makes it possible to omit bearing caps and connecting lines between the bearings and the valve means. By virtue of the structural integration of the valve and a bearing pedestal of the camshaft bearing, the control valve is situated within the valve cover on the cylinder head, and, as a result, there is no need for a line for returning the operating oil released from the coupling device to the oil sump.

In an advantageous configuration of the corresponding control valve, a central pressurized oil passage and the pressure control space are formed in the bearing pedestal and the valve housing. A first valve opening is arranged between the pressurized oil passage and the pressure control space, and a second valve opening is arranged between the pressure control space and the outside of the valve housing, in the wall of the latter. The control oil emerging from the second valve opening can flow back into the oil sump like the lubricating oil emerging from the bearings.

The valve is preferably a 3/2 way valve which comprises two closing members arranged on a common valve tappet, the first closing member being guided in a bore which extends perpendicularly to the first valve opening and the longitudinal axis of which is identical to the axis of the bore, forming the second valve opening, in the wall of the housing. Since the direction of motion of the valve tappet is transverse to the first valve opening, the pressure prevailing in the central pressurized oil passage does not have an effect on the motion of the valve, and a high switching speed in both directions of actuation is thus insured. In order that the lubricating oil can reach all the camshaft bearings in a simple manner, the camshaft is provided with a lubricating oil passage which extends in its longitudinal direction, this lubricating oil passage being connected to the central pressurized oil passage via a radially extending lubricating oil opening.

It is regarded as particularly advantageous that the rocker arm support shaft has an inner dividing wall which extends in the longitudinal direction, a lubricating oil passage thus being formed next to the hydraulic fluid passage. In this way, the rocker arm support shaft can simultaneously feed lubricating oil to the rocker arm bearings and pressurized oil to the coupling elements. By means of this measure, a further reduction in the outlay on machining and assembly is achieved. In order that the control speed in the hydraulic system for the coupling device is not impaired in any way, care should be taken that no restrictions are present in the hydraulic passage. It is therefore advantageous if the dividing wall in the rocker arm support shaft is arranged asymmetrically and the hydraulic passage has a considerably larger cross-section than the lubricating oil passage. Two rocker arm support shafts per cylinder head are provided, depending on the design of the internal combustion engine. In order that both rocker arm support shafts can assume the corresponding functions in the same way, the pressure control space comprises two portions, which are formed on both sides of the central pressurized oil passage, and there is one rocker arm support shaft arranged in each of the portions. The rocker arm support shafts may have different diameters.

Since the oil pump of an internal combustion engine is usually at its front end, it is regarded as particularly advantageous that the valve means for controlling the hydraulic pressure is arranged on the forwardmost bearing pedestal of the camshaft. In this way, the line length between the oil pump and the point of separation into lubricating oil, on the one hand, and pressurized fluid or control oil for the hydraulic coupling device, on the other hand, is kept as short as possible. In the case of internal combustion engines with a plurality of cylinder banks, preferably those which are configured as V engines, each cylinder bank includes valve means of identical construction installed in mirror image fashion.

An exemplary embodiment of the valve actuating system according to the invention is explained in greater detail below with reference to the drawings:

DESCRIPTION OF A PREFERRED EMBODIMENT

Figure 1:
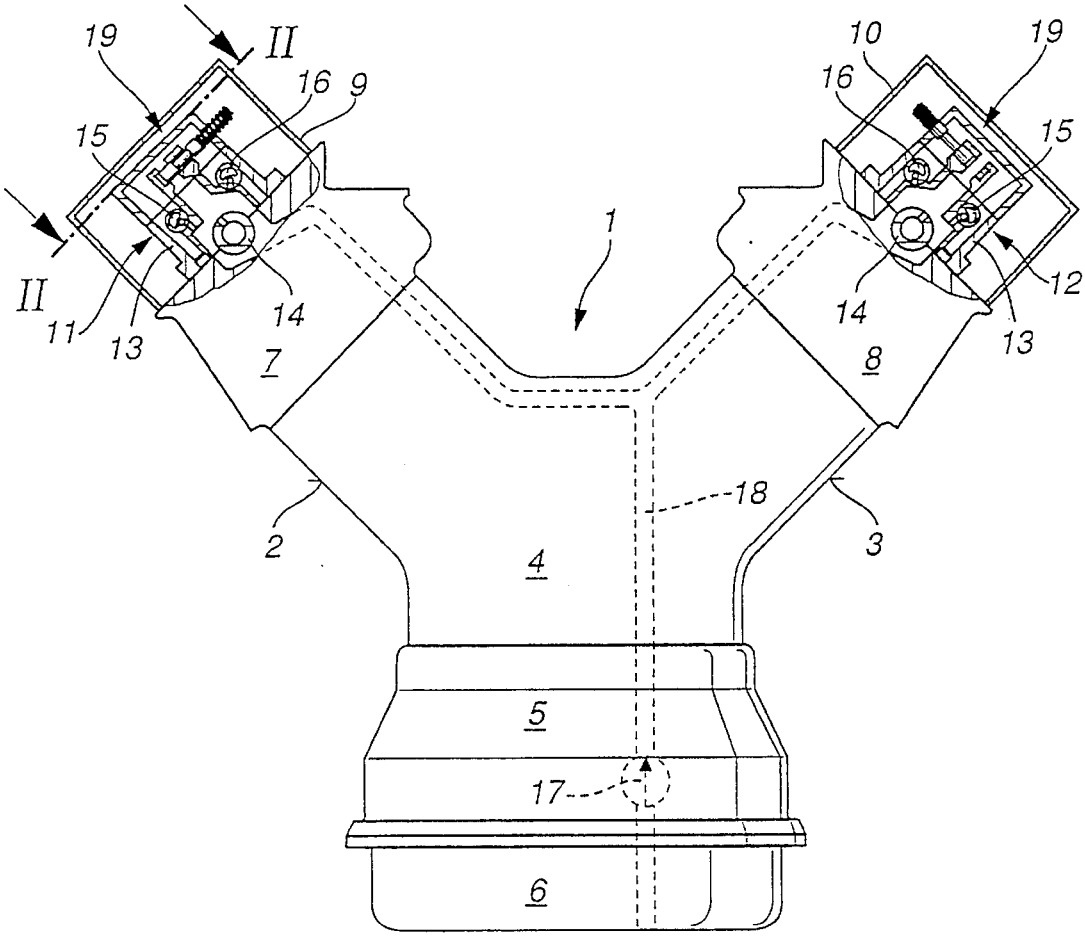
FIG. 1 is schematic representation of an internal combustion engine with a V-shaped cylinder arrangement and a pressurized oil line leading to the valve actuating mechanisms.

FIG. 1 is a schematic front view of an internal combustion engine 1 with two cylinder banks 2 and 3 arranged in the shape of a V, the engine comprising a cylinder block 4, a crankcase bottom part 5, an oil sump 6 and cylinder heads 7 and 8 arranged on the cylinder block 4. On the cylinder heads 7 and 8, there are valve actuating mechanisms 11 and 12 covered by cylinder head covers 9, 10. The valve actuating mechanisms 11, 12 are of identical design and in each case comprise a camshaft 14 mounted on slotted bearing pedestal 13, and two rocker arm support shafts 15, 16 with rocker arms mounted thereon for acting on valve tappets. Further details of this structure will be given below with reference to FIGS. 2–4. Provided at the front end of the internal combustion engine 1 is a pressurized oil line 18 which leads from an oil pump 17 to the forwardmost bearing pedestal 13 of each camshaft 14 and serves to supply lubricating oil to the camshaft and rocker arm bearings and oil under pressure to hydraulically actuated coupling devices for the rocker arms. The coupling devices are controlled in each case by a valve 19 mounted on the forwardmost bearing pedestal 13 of each camshaft 14.

Figure 2:
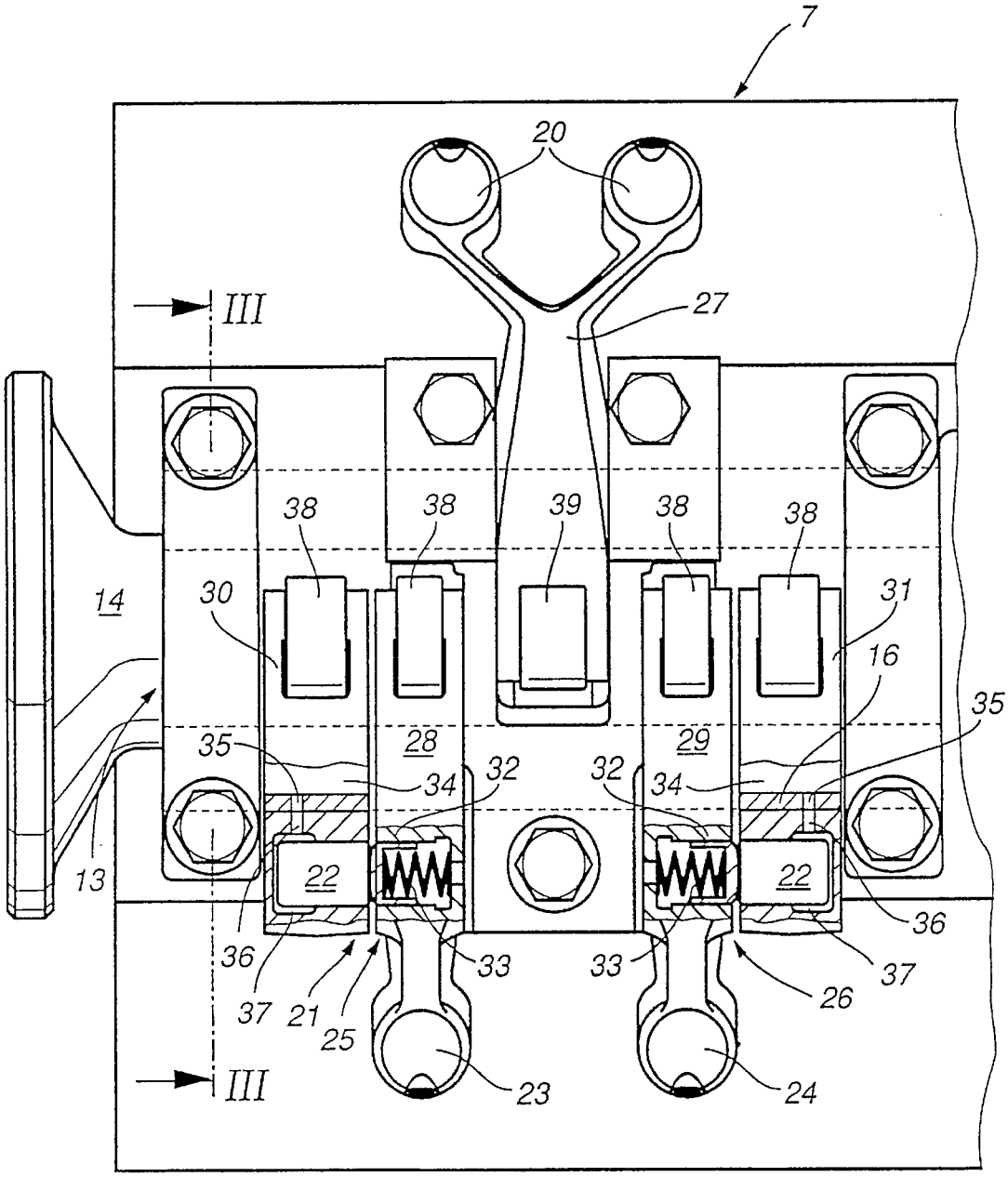
FIG. 2 is an enlarged partial view of the valve actuating mechanism taken along line II—II of FIG. 1.

FIG. 2 shows a section taken along the line II—II in FIG. 1 but, for reasons of clearer representation, without the cylinder head cover. Provided in the cylinder head 7 of the internal combustion engine 1 are two exhaust valves 20 and tow intake valves 23 and 24 for each cylinder, the valves being actuated via a rocker arm arrangement by the camshaft 14 mounted in the cylinder head 7. The rocker arm arrangement comprises a fork-like rocker arm 27 for actuating the two exhaust valves 20 and four rocker arms for the actuation of the two intake valves 23 and 24. Of the four rocker arms, two act as actuating levers 28, 29 and the other two act as coupling levers 30 and 31.

Rotatably mounted on the rocker arm shaft 16, on each side of the centrally arranged exhaust rocker arm 27, there is an actuating lever 28 and 29, respectively, and a coupling lever 30 and 31, respectively, and, of these, the actuating levers 28, 29 are arranged directly adjacent the exhaust rocker arm 27 which is rotatably mounted on the other rocker arm shaft 15.

The actuating lever and the associated coupling lever form a detachable unit or pairs of rocker arms 25, 26. Both rocker arm pairs 25 and 26 of each cylinder are provided with a respective coupling device 21, each of which comprises a pressure-actuable locking pin 22 and a spring-loaded guide cup 32. The locking pin is mounted in longitudinally displaceable fashion in the coupling lever, while the guide cup 32, together with the spring 33, is guided in longitudinally displaceable fashion in the actuating lever.

Depending on the position of the valve 19, pressurized oil is fed in through the hollow rocker arm support shaft 16, in which a hydraulic passage 34 is formed, the pressurized oil passing though holes 35, 36 in the rocker arm shaft 16 and in the rocker arms 30, 31 into pressure chambers 37, into which the locking pins 22 project. The exhaust valve rocker arm 27, the actuating levers 28, 29 and the coupling levers 30, 31 are provided with cams 38, 39 which rest against the camshaft.

Figure 3:
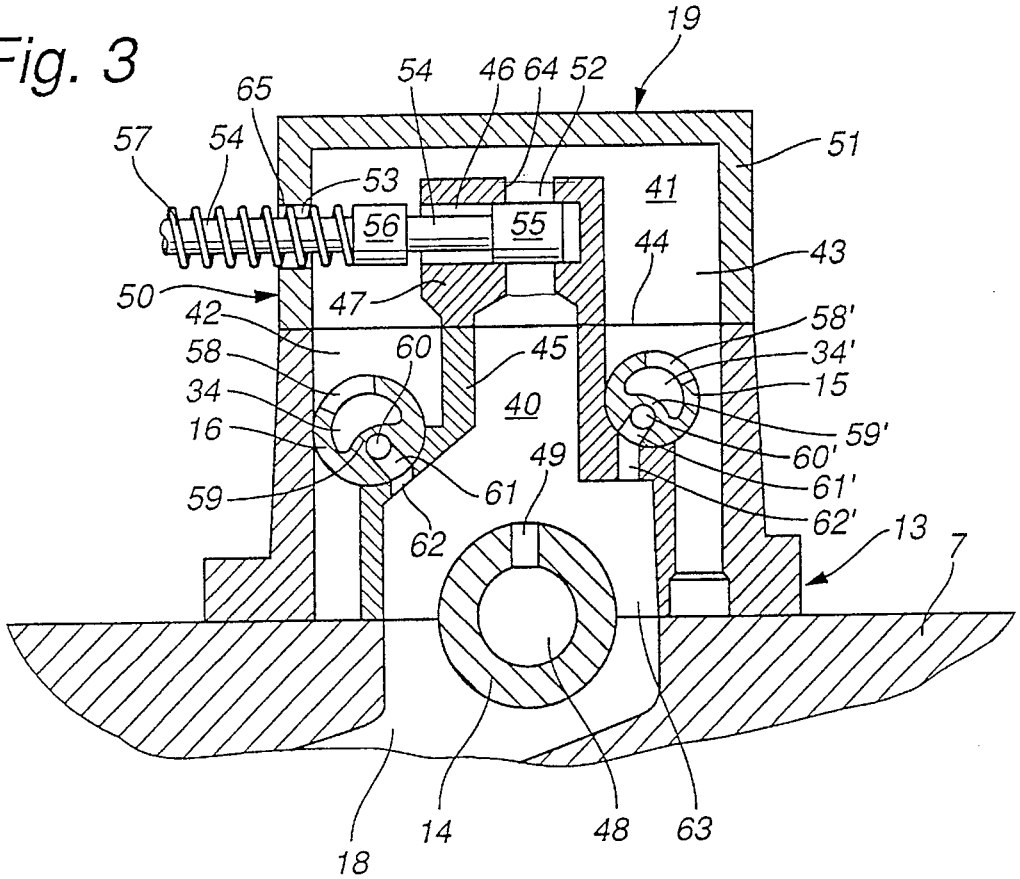
FIG. 3 is a cross-sectional view taken along line III—III of FIG. 2.
Figure 4:
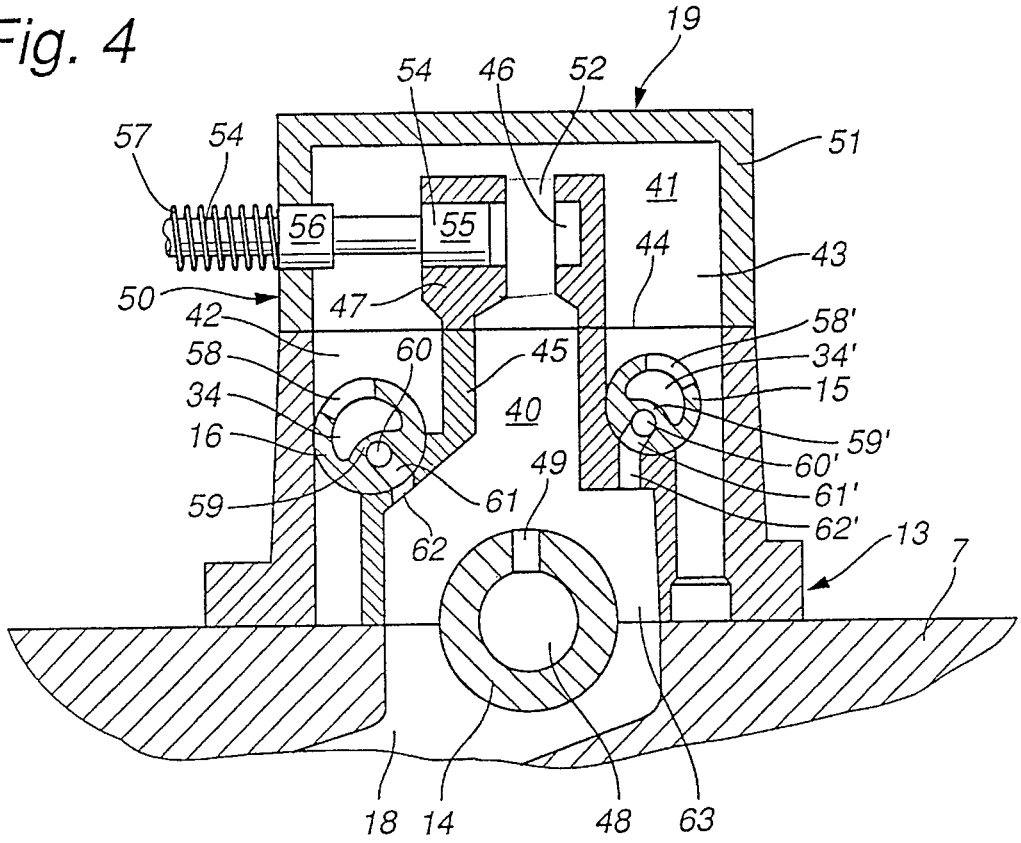
FIG. 4 is a view in accordance with FIG. 3 but showing the valve in a different position.

FIGS. 3 and 4 each show a section taken along line III—III in FIG. 2, the position of the valve in FIGS. 3 and 4 being different. Situated on the cylinder head 7 is the bearing pedestal 13, which supports the camshaft 14. Formed within the bearing pedestal 13 is an oil chamber 63, into which the pressurized oil line 18 opens. The camshaft 14 is hollow, providing for a lubricating oil passage 48 which extends in the longitudinal direction of the camshaft 14 and is in communication with the oil chamber 63 by way of a lubricating oil hole 49 in the camshaft 14. The oil chamber 63 is delimited by an inner wall 45, which, in its upper region, forms a central pressurized oil passage 40.

The numeral 44 denotes the upper boundary surface of the bearing pedestal 13, on which the valve 19 is placed and to which it is connected, so that the valve 19 and the bearing pedestal 13 are a constructional unit 15. A housing 51 of the valve 19 is therefore configured in such a way that it corresponds to the external dimensions of the bearing pedestal 13. An inner part 47 of the valve 19 adjacent the upper end of the wall 45 in the bearing pedestal 13 includes a bore 64 extending in the longitudinal direction of the pressurized oil passage 40 and a bore 46 which extends perpendicularly relative to the abovementioned bore 64 is provided in the inner part 47. The bore 64 forms a first valve opening 52, and a first closing member 55 of the valve 19 is displaceably guided in the bore 46, so that the first valve opening 52 is open or closed, depending on the position of the closing member 55.

In the housing 51 of the valve 19 there is a bore 65, which lies on a common axis with the bore 46 in the inner part 47. Extending through the bore 65 is a valve tappet 54 carrying at its front end the first closing member 55. At an appropriate distance, there is likewise on the valve tappet 54 a second closing member 56, which serves to open and close the bore 65 forming a second valve opening 53, depending on the control state of the valve 19.

A pressure control space 41 is formed between the inner part 47 and the housing 51 of the valve 19, this pressure control space comprising a portion 42 and 43 on each side of the central pressurized oil passage 40. These portions 42 and 43 extend into the bearing pedestal 13, and the front ends of the rocker arm support shafts 15 and 16 are in each case arranged in these portions 42 and 43. The rocker arm support shafts 15 and 16 each have two passages extending in the longitudinal direction of the shafts one of these passages being designed as a pressurized hydraulic fluid passage 34, 34' and the other being designed as a lubricating oil passage 60, 60'.

The hydraulic fluid passage 34, 34' is separated from the lubricating oil passage 60, 60' by a dividing wall 59, 59', which extends in the longitudinal direction of the rocker arm shaft 16, 15. The hydraulic fluid passage 34, 34' is in communication with portions 42 and 43, respectively, of the pressure control space 41 via a radial opening 58, 58'. In the rocker support shaft 16, there is a radial opening 61 which starts from the lubricating oil passage 60 and, in alignment therewith, there is a corresponding opening 62 in the wall 45, the lubricating oil passage 60 thus being in communication with the central pressurized oil passage 40 and the oil chamber 63. A corresponding configuration of openings 61' and 62' to provide for communication between the oil chamber 63 and the lubricating oil passage 60' is present on rocker arm support shaft 15.

As can be seen from FIGS. 3 and 4, the rocker arm support shafts 15 and 16 can have different diameters. However, the arrangement is such that the distances between the centers of the rocker arm support shafts 15, 16 and the center of the camshaft 14 are equal.

The camshaft bearing pedestal 13 is configured in such a way that, in the absence of valve 19, it can be provided with a sealing cover on the upper boundary surface 44. In this case, identical bearing pedestals can be used irrespective of whether a controllable valve actuating mechanism with hydraulic actuation is provided or not.

To actuate the coupling device 21 shown in FIG. 2, the valve 19 is moved into the position shown in FIG. 4. For this purpose, the valve 19 is preferably designed as an electromagnetically controlled valve, the actuation time of which is within the range of a few milliseconds. In this position, the second valve opening 53 is closed and the first valve opening 52 is open, with the result that pressurized oil passes into the pressure control space 41 and there builds up a hydraulic pressure which propagates through the radial openings 58, 58' and the hydraulic passages 34, 34' to the pressure chambers 37 in the coupling levers 30 and 31 moving the locking pin 22 against the spring 33 for engagement of the levers. In this way, the coupling levers 30, 31 are coupled to the actuating levers 28, 29. If the locking pin 22 is to return to the initial position for disengagement of the levers, the valve 19 is moved into the position shown in FIG. 3, in which the first valve opening 52 is closed and the second valve opening 53 is open. This blocks the flow of oil out of the central pressurized oil passage 40 into the pressure control space 41. At the same time, the pressure control space 41 is placed in communication with the outside of the housing 51, where there is essentially no pressure. In this way, the pressure in the pressure control space 41 and the hydraulic passages 34, 34' and the pressure chambers 37 can be dissipated extremely rapidly, whereby the springs 33 push the locking pins 22 back into the initial position as shown in FIG. 2.

What is claimed is:

1. A valve actuating system for a multicylinder internal combustion engine having for each cylinder at least one intake valve and one exhaust valve, a camshaft supported in bearing pedestals mounted on a cylinder head, an arrangement of rocker arms pivotally supported by rocker arm support shafts also mounted on said bearing pedestals such that said rocker arms are operable by said cam shaft for actuating said valves, a coupling lever arranged adjacent at least one of said rocker arms and including a hydraulically operable coupling device for coupling said coupling lever with the adjacent rocker arm, and valve means arranged on at least one of said bearing pedestals and defining, with said bearing pedestal a pressure control space, at least one of said rocker arm support shafts having an axial pressurized fluid passage providing for communication between said pressure control space and said hydraulically operable coupling devices, said valve means being adapted to control the admission of pressurized fluid to said pressure control space and, consequently, to said coupling devices in said coupling levers.

2. A valve actuating system according to claim 1, wherein said valve means is arranged in a valve housing mounted on top of said bearing pedestal and forms a unitary structure therewith.

3. A valve actuating system according to claim 2, wherein a central pressurized fluid passage and said pressure control space are formed in said unitary structure and a first valve opening is arranged between said pressurized fluid passage and said pressure control space and a second valve opening extends between said pressure control space and the outside of said valve housing.

4. A valve actuating system according to claim 3, wherein said valve means is a 3/2 way valve which comprises two closing members disposed on a common valve tappet, the first closing member being movably disposed in a first bore extending normally with respect to the first valve opening and being adapted to block or open said first valve opening and the second closing member being movable into and out of a second bore arranged in said valve housing in axial alignment with said first bore, said closing members being spaced from another such that when said first valve opening is blocked by said first closing member, said second closing member is outside said second bore and when said first closing member is retracted to open said first valve opening said second closing member is disposed in said second bore.

5. A valve actuating system according to claim 3, wherein a lubricating oil passage extends axially through said cam shaft, and said camshaft has a radial lubricating oil hole arranged so as to provide for communication of said axially extending lubricating oil passage with said central pressurized fluid passage.

6. A valve actuating system according to claim 3, wherein said rocker arm support shaft has an axially extending inner dividing wall dividing the interior thereof into a lubricating oil passage and a pressurized hydraulic fluid supply passage.

7. A valve actuating system according to claim 6, wherein radial openings are provided in said rocker arm support shaft in alignment with openings formed in said inner wall of said bearing pedestal to establish communication between said central pressurized oil passage and said lubricating oil passage in said rocker arm support shaft.

8. A valve actuating system according to claim 6, wherein said dividing wall in said rocker arm support shaft is non-symmetrical so as to provide a substantially larger flow cross-section for said pressurized hydraulic fluid supply passage than for said lubricating oil passage.

9. A valve actuating system according to claim 3, wherein said pressure control space comprises two portions, one at each of opposite sides of said central pressurized fluid passage and a rocker arm support shaft is arranged in each of the two portions.

10. A valve actuating system according to claim 9, wherein the two rocker arm support shafts have different diameters.

11. A valve actuating system according to claim 1, wherein said valve means are arranged on the forwardmost bearing pedestal of said camshaft.

12. A valve actuating system for a multicylinder system for a multicylinder internal combustion engine according to claim 1, wherein said internal combustion engine comprises two cylinder banks arranged in the shape of a "V", each bank having a valve operating mechanism of identical design arranged in mirror image fashion.

* * * * *